United States Patent [19]

Cochran

[11] 3,973,587

[45] Aug. 10, 1976

[54] CHECK VALVE ASSEMBLY

[75] Inventor: Chudleigh B. Cochran, Houston, Tex.

[73] Assignee: Brown Oil Tools, Inc., Houston, Tex.

[22] Filed: Apr. 25, 1975

[21] Appl. No.: 571,609

[52] U.S. Cl. ..... 137/496; 137/516.11

[51] Int. Cl.[2] ..... E21B 43/00

[58] Field of Search ..... 137/496, 498, 460, 516.11, 137/516.15, 625.28, 625.29, 625.30, 625.38, 625.39; 166/224

[56] References Cited

UNITED STATES PATENTS

| | | | |
|---|---|---|---|
| 3,090,443 | 5/1963 | Bostock | 166/224 A |
| 3,794,112 | 2/1974 | Hill | 166/224 A X |

FOREIGN PATENTS OR APPLICATIONS

| | | | |
|---|---|---|---|
| 303,041 | 12/1928 | United Kingdom | 137/625.39 |

*Primary Examiner*—Henry T. Klinksiek
*Attorney, Agent, or Firm*—Torres & Berryhill

[57] ABSTRACT

A check valve assembly for use in a flow conductor. A tubular valve body with a central flow passage is mounted in the assembly. A spring urges the body toward closed position in which a rigid sleeve encircles and covers outlet ports in the downstream end of the body. A resilient skirt of rubber extending from the end of the sleeve engages the outer surface of the body to form a seal which prevents reverse fluid flow through the valve. The rigid sleeve isolates the ports from high reverse pressure differentials. Forward flow, or a sufficiently great forward pressure differential, overcomes the spring bias and pushes the downstream end of the tubular body through the bottom of the sleeve and skirt to a position in which the outlet ports are uncovered for normal flowing operation. The spring returns the valve body to closed position when the flow reverses or the forward pressure differential falls below a prescribed value.

10 Claims, 3 Drawing Figures

CHECK VALVE ASSEMBLY

BACKGROUND OF THE INVENTION

The present invention relates to a means for preventing reverse flow through conductors. More spcifically, the present invention relates to a check valve assembly or device which when situated in a flow conductor, such as a pipe string, will permit the flow of fluids through the conductor only in one direction. In a particular application, a ckeck valve of the assembly of the present invention is adapted to allow well bore fluids, such as drilling fluids, workover fluids, etc., to be injected into the wellbore, but to prevent reverse, upward flow of fluids in the string when equipment failures occur or unexpected high pressure is encountered downhole.

Check valve devices commonly employed in oil and gas wells may be broadly placed into two categories, those which are designed to permit a controlled, upward flow of fluids in the well tubing and those which are designed to prevent any upward flow of such fluids.

The first category of check valve are commonly used in production strings and serve to shut down production when necessitated, for example, by equipment failure at the wellhead. These devices commonly employ a flow responsive valve which automatically closes when the upward flow rate of the production fluid exceeds a selected maximum value.

The second category of check valves includes those which are designed to permit only downward flow of fluids into the well tubing, and which automatically close in response to a reverse in the flow direction. Recent improvements in such check valves, illustrated in U.S. Pat. No. 3,850,191, employ a ball element in a recessed side chamber which communicates with the flowstream through a downstream pressure passage. The ball is displaced from the recess by reverse flow to block the tubing.

The many prior art devices, the surface with which the valve element must seat is subjected to the effects of the abrasive and corrosive fluids, such as argillaceous drilling fluids, or acidic workover and fracturing fluids frequently sent down hole from the surface. The erosion and corrosion may cause substantial wear or channeling of the valve seat and any other element in the fluid flow path, such that an imperfect seal is formed when the reverse flow conditions occur.

Another aspect of certain prior art devices is their general reliance on the reverse flow of the fluids, rather than the absence of forward flow, to activate the check valve operation. Under some circumstances, valves of this design may be prevented from closing if the reverse flow occurs too rapidly or forcefully. Moreover, in conventional valve closures, flow of material in the tubing may carry extraneous material into the seat area and block a complete seal.

SUMMARY OF THE INVENTION

The present invention provides a new and improved check valve to prevent reverse flow of fluids in well tubing, but allows relatively unrestricted fluid flow in one direction. The present check valve assembly operates on the positive pressure of flowing fluids. Briefly, the check valve is provided with a means which will prevent reverse flow in a tubing string in the absence of a positive flow in the forward or desired direction of fluid flow.

In a preferred embodiment of the present invention, a slidable tubular member, closed at the downstream end and with outlet openings adjacent thereto, is located in a housing to which is attached a tubular sleeve of resilient material which seals the openings against reverse flow in the absence of a flow in the desired forward flow direction. The slidable member moves against a spring bias during positive flow in the forward direction which frees the openings of the closure member to permit relatively unimpeded forward flow.

The check valve of the invention works against a spring bias so that it may be closed in response to either a decrease in flowrate or a cessation of the flow in the desired direction without reliance on any reverse flow to activate the valve. One of the important features of the check valve assembly of the present invention is its ability to permit forward flow for prolonged periods in which the fluid may severly corrode and erode the outlet openings in the valve and yet be capable of full and complete closure in the event the flow rate drops below prescribed limits or the direction of flow is reversed. To this end, the closure element is formed from a resilient tubular sleeve-like element which is telescoped over the end of the tubular body of the valve. When the flow rate decreases or the flow direction is reversed, the resilient sleeve functions to seal over the outlet ports in the body even though the ports may have been damaged by the flowing fluid. During periods of forward flow, the sleeve is well removed from the flow path so that it is protected from the abrasive effects of the flow. The sleeve may be constructed of rubber or other suitable material which is resistant or chemically immune to the well fluids. The valve includes a rigid protective sleeve into which the ports are withdrawn when the valve closes so that only the small annular area between the rigid sleeve and the valve body is exposed to the pressure differential. This feature prevents even extremely large pressure differentials from causing leakage or damaging the resilient sleeve.

Other features, objects and advantages of the invention will become more readily apparent from the accompanying drawings, specification and claims.

BRIEF DECRIPTION OF THE DRAWINGS

DESCRIPTION OF THE ILLUSTRATED EMBODIMENT

Figure 1:
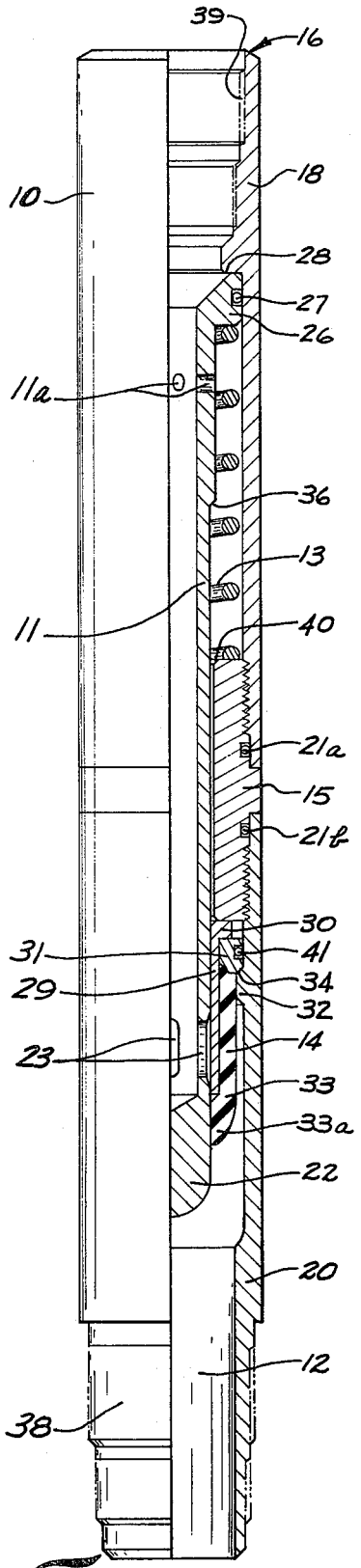
FIG. 1 is a partial cross-sectional vertical elevation illustrating one embodiment of the ckeck valve assembly of the present invention in a closed position.

Referring to FIG. 1, the check valve assembly of the present invention is shown generally at 16. The valve is comprised of four principal components, i.e., a housing body 10 which is generally cylindrical with a longitudinal central flow opening 12 therethrough, a slidable tubular valve member 11 which reciprocates in the opening 12, a helical opening biasing spring 13, and a seal or closure assembly 14. As used herein, the terms "upstream" and "downstream" relate to the forward,, desired direction of fluid flow.

The housing 10 of valve 16 has a central collar 15 which is threaded between an upstream housing section 18 and a downstream housing section 20. Resilient O-ring seals 21*a* and 21*b* encircle the collar 15 to form a fluid tight seal between the collar and the housing sections 18 and 20.

The member 11 is closed at its downstream end by a blunt nose 22 and is equipped with outlet ports or openings 23 which extend radially through the tube walls.

At the upstream end of the slidable member 11, an outwardly annular flange 26 slidably engages the inner wall of the housing section 18. A resilient O-ring seal 27 seated in and encircling the annular flange 26 forms a fluid tight sliding seal between the member 11 and the housing section 18. Ports 11*a* permit fluid to escape from the area between the member 11 and the housing section 18 when the member 11 moves downwardly to thereby prevent the development of a pressure lock which might keep the valve in open position.

Located between the member 11 and the housing section 18 is a helical spring 13, seated between the annular flange 26 and the central collar 15, and biasing the member 11 toward the upstream end of the check valve assembly 16. An inwardly projecting annular shoulder 28 limits the upward movement of the member 11. The annular flange 26 is moved against the shoulder 28 by the spring 13 when the assembly is closed. A shoulder 36 contacts an upper surface 40 on the collar 15 to check the downward movement of member 11. In FIG. 1, the helical spring 13 is in its extended (uncompressed) configuration and has moved the outlet openings 23 toward the upstream end of the assembly 16 where they are covered by the seal assembly 14 which is secured to the housing 20. The strength of the helical spring 13 determines the minimum flow rate or positive pressure differential required to open the valve for flow, or to keep the valve open, and below which rate or presssure differential, all flow is terminated.

The seal assembly 14 includes a rigid sleeve 29 which slidably engages the member 11 and covers the openings 23 when the helical spring 13 is in its extended configuration. The rigid sleeve 29 has an outwardly extending flange 30 and is fixed in the central bore 12 by the gripping of flange 30 between a bushing 31 and the collar 15. The bushing 31 is held in place by a frusto-conical surface 34 formed on an inwardly projecting shoulder 32 of the housing section 20. A resilient O-ring seal 41 forms a fluid tight seal between the housing section 20 and the bushing 31.

The active sealing element of the valve of the present invention is a resilient sealing sleeve 33 which is bonded to the rigid sleeve 29 or otherwise fixed to allow the member 11 to be movable relative to the resilient sealing sleeve. The lower end of the sleeve 33 forms a skirt 33*a* which extends below the sleeve 29 and projects inwardly to seal against the external cylindrical surface of the member 11. The skirt 33*a* is in sliding engagement with the member 11 such that the member is permitted to move between the two positions illustrated in FIGS. 1 and 2. The external edges of the outlet openings 23 are bevelled to provide a smooth surface which reduces interference with the movement of the member 11 through the rsilient sleeve skirt 33*a* and streamlines the flow passage to reduce flow turbulence.

The check valve assembly 16 is provided at its downstream end with male coupling arrangement 38 and at the opposite end with a female coupling arrangement 39 to connect the assembly 16 directly into a tubing string. It may be appreciated that the assembly 16 may be retrievable, self-contained assembly which may be landed in, or retrieved from, a flow string using conventional equipment and techniques.

THEORY OF OPERATION

Figure 2:
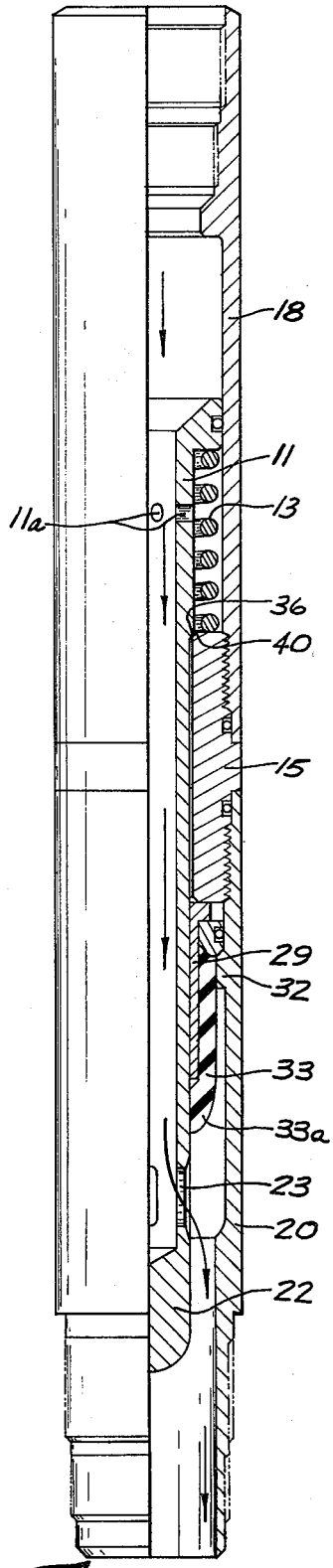
FIG. 2 is a partial cross-sectional vertical elevation of the check valve embodiment of FIG. 1 in an open position.

When a flow of sufficient rate, or a pressure differential of sufficient magnitude, in the direction of the arrows in FIG. 2 is achieved, the slidable member 11 is moved in the direction of the flow, compressing the helical spring 13. This movement continues until the shoulder 36 engages the surface 40 on the collar 15. When a predetermined presssure differential is provided, the fluid pressure tends to balloon the sleeve skirt 33 so that flow is premitted. The pressure differential and the frictional drag created by the flow of the fluid exert a downward force on the member 11 which overcomes the spring bias and moves the member downwardly until the openings 23 are moved free of the skirt 33*a*. The member 11 is held in lower position, seen in FIG. 2, with the ports 23 exposed, so long as the flow rate exceeds a value which is dependent upon the type of fluid flowing through the opening, the spring force, the dimensions of the various flow passages and ports and other factors.

In the event the flow rate in the direction of the arrows is reduced below the preset minimum, either by cessation of the flow, e.g., pump or equipment faliure at the surface or because of a greater acting from below, the helical spring 13 will move the slidable member 11 into the closed position, in which the ports 23 are withdrawn below the rigid sleeve 29 and the skirt seals along the external surface of the member 11. The greater pressure from below serves to drive the skirt firmly against the member 11 to fill in any voids or irregularities caused by corrosion, wear or other factors. The skirt 33*a* thus functions to provide a seal between the rigid sleeve 29 and the member 11 while the sleeve 29 acts to isolate the large ports 23 from the downstream pressure. The result is that the assembly 16 may withstand extremely large reverse pressured differentials without leakage and without exposing the resilient sleeve 33 to rupturing or distorting forces.

Figure 3:
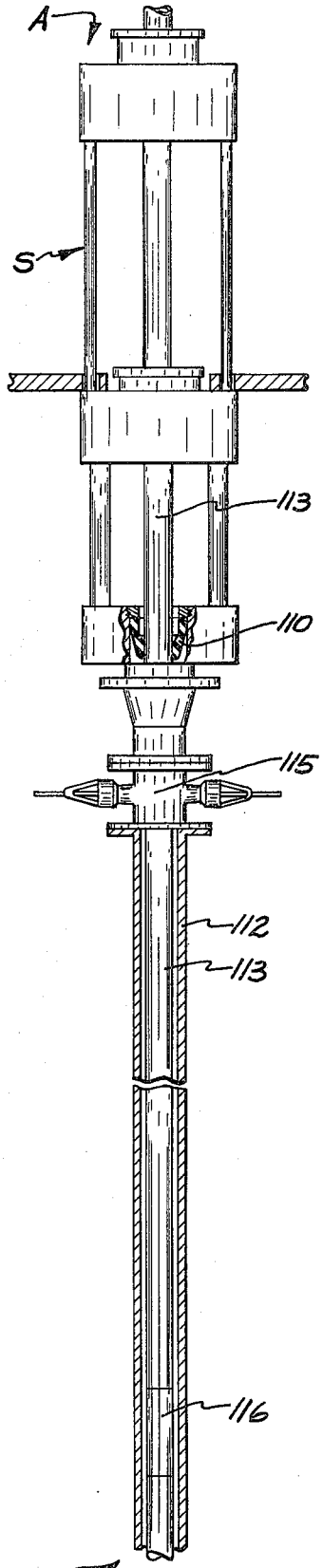
FIG. 3 is a schematic vertical elevation, in partial cross-section, illustrating the use of the present check valve assembly in well tubing in a snubbing operation.

In FIG. 3, an exemplary application of the check valve assembly is shown in a snubbing operation. A well, designated A, employs a check valve assembly of the present invention, generally indicated at 116. A tubular stripper seal 110 forms a distensible seal between a casingstring 112 and a tubing string 113. Below the snubber, which is generally designated as S, is a blowout preventer 115, which is left open when running pipe, and which is hydraulically operated to close off the well in the event of a blowout.

Briefly, in the snubbing operation, a reciprocating element of the snubber grips the pipe 113 and forceably inserts it into the well A against the well pressure which is tending to force the pipe out of the well. In the system of FIG. 3, pump presure is applied from the surface through the pipe 113 as the pipe is being inserted into the well. A full discussion of typical snubber operation and a particular apparatus may be found in U.S. Pat. No. Re. 25,860.

In the example of FIG. 3, the check valve assembly 116 prevents any high pressure well fluids from flowing upwardly through the pipe 113 in the event, for example, the surface pump breaks down or the pipe 113 develops a leak above the valve 116 or higher pressures are accidentally encountered downhole. It is apparent that more than one check valve assembly could be used or that combinations of the present check valve assembly with other such devices could be employed to increase the margin of safety.

The check valve assembly is described in use in a snubbing operation, however, it could serve just as well in drilling, workover, fracturing or the like operations. It should also be noted that, if desired, the valve components may be arranged so that their movements are reversed. Thus, the seal assembly 14 may be mounted for fluid induced movement through the housing 10 while the valve member 11 remains fixed. Other variations will also occur to those having ordinary skill in the art.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. A check valve assembly for permitting only forward flow of fluid from an upstream to a downstream location through said assembly comprising:

a. valve housing means having an internal flow opening;

b. valve member means extending longitudinally through the flow opening of said housing means;

c. longitudinally extending flow passage means in said valve member means;

d. outlet opening means in said valve member means for communicating said flow passage means with the internal flow opening of said housing means;

e. resilient sealing means for forming a seal between said housing means and said valve member means;

f. biasing means for urging said valve member and said sealing means relative to each other to a position in which said outlet opening means is upstream from said sealing means to prevent reverse flow through said flow passage means; and g. opening means responsive to the application of fluid induced forces, acting from upstream to downstream and exceeding a predetermined minimum value, for moving said valve member and said sealing means relative to each other to a position in which said outlet opening means is downstream from said sealing means to permit forward flow of fluid through said flow passage means.

2. A check valve assembly as defined in claim 1 wherein:

a. said valve member means includes a cylindrical outer surface downstream of said outlet opening means; and b. said resilient sealing means comprises an annular seal which engages and seals with said cylindrical outer surface when said outlet opening means are upstream of said sealing means.

3. A check valve assembly as defined in claim 2 wherein said valve member means is movable longitudinally through said housing means.

4. A check valve asembly as defined in claim 3 further including rigid, protective means, fixed substantially between said valve member means and said resilient sealing means, and relative to which said valve member means is movable, for covering said outlet opening means and providing rigid support for said resilient sealing means when said annular seal engages and seals with said cylindrical outer surface of said valve member means.

5. A check valve assembly as defined in claim 4 wherein:

a. said protective means comprises a rigid tubular sleeve, having a first end and a second end, closely surrounding said valve member means, with said first end connected to said housing means;

b. said sealing means comprises a resilient tubular sleeve surrounding said rigid sleeve, with a skirt section extending beyond said second end of said rigid sleeve for engagement with said cylindrical outer surface of said valve member means; and c. said biasing means comprises a helical spring disposed coaxially with said valve member means.

6. A check valve assembly as defined in claim 5 wherein:

a. said outlet opening means comprise a plurality of radially extending ports; and b. the radially outward edges of said ports are bevelled to reduce turbulence in said forward flow of said fluid from said flow passge means to said internal flow opening.

7. A check valve assembly a defined in claim 3 wherein:

a. said sealing means is fixed relative to said housing means; and b. said biasing means includes a helical spring means disposed between said valve member means and said housing means.

8. A check valve assembly as defined in claim 4 wherein:

a. said sealing means is fixed relative to said housing means; and b. said biasing means includes a helical spring means disposed between said valve member means and said housing means.

9. A check assembly as defined in claim 4 wherein:

a. said housing comprises upstream and downstream tubular bodies secured to central collar;

b. said valve member means comprises a tubular body, closed at its downstream end and provided with a flange at its upstream end; and c. said biasing means comprises a helical spring encircling said valve member means and disposed between said flange and said collar within said housing means.

10. A check valve assembly as defined in claim 5 wherein:

a. said housing comprises upstream and downstream tubular bodies secured to a central collar;

b. said valve member means comprises a tubular body, closed at its downstream end and provided with a flange at its upstream end; and c. said biasing means comprises a helical spring encircling said valve member means and disposed between said flange and said collar within said housing means.

* * * * *

UNITED STATES PATENT OFFICE

CERTIFICATE OF CORRECTION

Patent No. 3,973,587 Dated August 10, 1976

Inventor(s) Chudleigh B. Cochran

It is certified that error appears in the above-identified patent and that said Letters Patent are hereby corrected as shown below:

Column 1, line 6, after the word "through" insert --flow--.

Column 1, line 11, delete the word "ckeck" and insert therefor --check--.

Column 1, line 40, delete the word "The" and insert --In--.

Column 2, line 18, delete the word "severly" and insert therefor --severely--.

Column 2, line 46, delete the word "ckeck" and insert therefor --check--.

Column 2, line 65, delete ",," and insert therefor --,--.

Column 3, line 63, delete the word "rsilient" and insert therefor --resilient--.

Column 3, line 67, after the word "with" insert --a--.

Column 4, line 3, after the word "be" insert --a--.

Column 4, line 16, delete the word "premitted" and insert therefor --permitted--.

Column 4, line 21, after the word "in" insert --its--.

Column 4, line 30, after the word "greater" insert --pressure--.

UNITED STATES PATENT OFFICE
CERTIFICATE OF CORRECTION

Patent No. 3,973,587 Dated August 10, 1976

Inventor(s) Chudleigh B. Cochran

It is certified that error appears in the above-identified patent and that said Letters Patent are hereby corrected as shown below:

Column 4, line 59, delete the word "presure" and insert therefor --pressure--.

Column 4, line 62, delete the word "operation" and insert therefor --operations--.

Column 5, line 62, delete the word "asembly" and insert therefor --assembly--.

Column 6, line 27, delete the word "passge" and insert therefor --passage--.

Column 6, line 43, after the word "check" insert --valve--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*